US006324944B1

(12) United States Patent
Presa Eguren

(10) Patent No.: US 6,324,944 B1
(45) Date of Patent: Dec. 4, 2001

(54) SPIRAL FOR CORKSCREW

(76) Inventor: Jacinto Presa Eguren, Avenida de Atenas, 75, Las Rozas Madrid E-28230 (ES)

( * ) Notice: Subject to any disclaimer, the term of this patent is extended or adjusted under 35 U.S.C. 154(b) by 0 days.

(21) Appl. No.: 09/486,789

(22) PCT Filed: Jun. 24, 1999

(86) PCT No.: PCT/ES99/00191

§ 371 Date: May 30, 2000

§ 102(e) Date: May 30, 2000

(87) PCT Pub. No.: WO00/01611

PCT Pub. Date: Jan. 13, 2000

(30) Foreign Application Priority Data

Jul. 3, 1998 (ES) ..... 9801767 U

(51) Int. Cl.[7] ..... B67B 7/00
(52) U.S. Cl. ..... 81/3.45; 81/3.48
(58) Field of Search ..... 81/3.45, 3.48

(56) References Cited

U.S. PATENT DOCUMENTS 172,868 * 2/1876 Clough ..... 81/3.45
330,974 * 11/1885 Friedmann et al. ..... 81/3.45
4,253,351 * 3/1981 Allen ..... 81/3.29

FOREIGN PATENT DOCUMENTS

1029130 U 4/1995 (ES) .
943347 * 3/1979 (FR) ..... 81/3.45
661220 * 11/1951 (GB) ..... 81/3.45
2127795 A 4/1984 (GB) .
9715523 A 5/1997 (WO) .

* cited by examiner

*Primary Examiner*—Joseph J. Hail, III
*Assistant Examiner*—Joni B. Danganan
(74) *Attorney, Agent, or Firm*—Michael J. Striker

(57) ABSTRACT

A spiral for a corkscrew has a spiral member with a pointed end for introduction into a cork of a bottle and also, with a part which is located opposite to the pointed introduction end and having an opposite end, a ball bearing connected with the opposite end of the spiral member, so that during introduction of the spiral member into a cork and removal of the screw member from the cork the spiral member is rotated relative to a rest of the corkscrew, and an element for connecting the ball bearing with the opposite end of the part of the screw member.

4 Claims, 1 Drawing Sheet

SPIRAL FOR CORKSCREW

PURPOSE OF THE INVENTION

This invention refers to an improved spiral for corkscrews contributing novel characteristics and important advantages with respect to devices known and used in the current state of the art.

More specifically, the invention proposes the development of a spiral component applicable to any kind of corkscrew known for its use to remove corks from bottles, the characteristics of this spiral component corresponding to those of any known, regarding shape, material used in their manufacture and finish and by which a component is provided which is easily introduced into the cork of a bottle, by simple friction, and the removal thereof may be performed smoothly and without effort, thanks to a ball-bearing in the upper part of the spiral.

The field of application of this invention is obviously included in the industry dedicated to the manufacture and marketing of corkscrews of any kind.

BACKGROUND AND SUMMARY OF THE INVENTION

Many models of corkscrew are known in the market, intended to simplify the removal of corks used to close bottles of wine or similar fluids.

Generally, all these corkscrews, whether manual, portable, wall, traditional or of the mechanism type, etc, have the common characteristic of incorporating a spiral component of a predetermined length to remove corks and which normally finish in a sharp tip to facilitate the nailing and introduction operations. Said tip is rotated with respect to the rest of the corkscrew in which it is incorporated, both during the introduction and removal operations. As a result, for such operations to be performed easily and comfortably, in practice it is desirable that the mentioned relative movement of the spiral is made as smoothly as possible.

However, frequently the latter is not as simple as desired and the spiral is submitted to incorrect operations, as a result of jamming, wear, etc.

Therefore, the invention proposes as a basic purpose, the provision of a spiral solving the problems of the previous state of the art, by providing minimum friction when performing the rotational movement relative to that of penetration in a cork, as well as total smoothness and negligible effort when removing a cork.

For the latter, the spiral component has been equipped with a suitable bearing, specifically a ball-bearing, by which said rotational movement is produced. This bearing is fixed to the upper part of the spiral for which an initial part thereof has been suitably shaped, to permit that the retention between both components may be carried out by using a means such as a rivet or similar.

As will be understood, the bearing permits that the relative movement of the spiral around its longitudinal axis is performed uniformly, absolutely smoothly, and practically without effort, hence extending the useful life of the mechanism.

BRIEF DESCRIPTION OF THE DRAWINGS

These and other characteristics of the invention are shown by means of the following detailed description of a preferable execution, taken as an illustrative and non-limiting example, with reference to the attached drawings, where.

DESCRIPTION OF A PREFERABLE EXECUTION OF THE INVENTION

Figure 1:
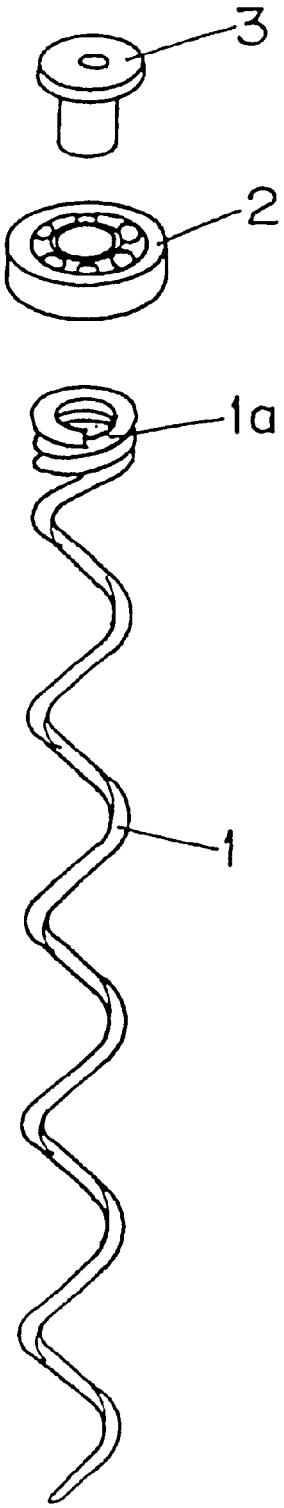
FIG. 1 shows a perspective view of a breakdown of a spiral according to the invention, where different components thereof are seen and, FIG. 2 also shows a perspective view of the spiral of FIG. 1, once assembled.
Figure 2:
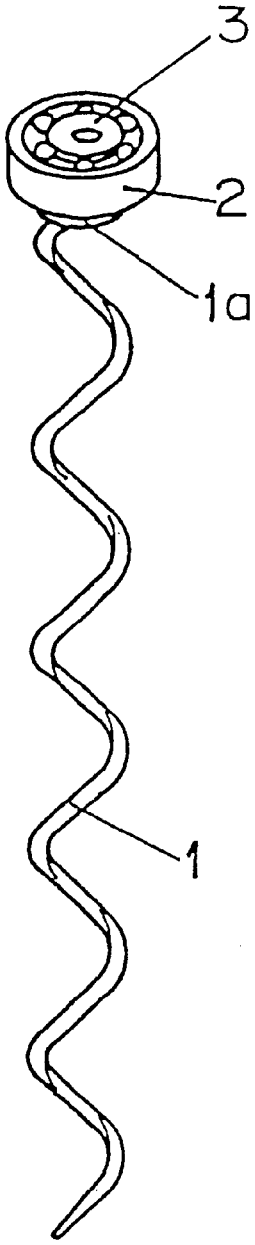

To make a detailed description of this invention, reference will be made to the figures of the attached drawings, by which an illustrative example of the preferable execution is made and in which the spiral of the invention may be observed in its broken-down state, showing the different components integrating it and in its assembled state, that is, ready for its installation in a corkscrew. Firstly, if we consider FIG. 1, it is seen that the components involved in the construction of the spiral component consist of a body (1) or spiral, a bearing (2), with predetermined formal and structural characteristics and a relative fastening device (3) between the body (1) and the bearing (2) and which will preferably consist of a suitable rivet or similar. According to FIG. 1, the body (1) may be constructed with any shape, size, number of turns or final characteristics desired, since none of the latter intervene (nor represent an obstacle) in the materialization of the invention. However, and according to the invention, the body (1) includes in its upper part, an initial section **(1*a*), specially shaped, with less separation between its turns, to supply an area with the structural resistance necessary for the secure fastening of the bearing (2). This fastening is performed by leaning the respective face of the bearing (2) against the corresponding free end of the spiral, that is, the free end of the part (1*a*), and with the use of a rivet or similar device (3), which is made to pass through the axial hole of the bearing (2) in its position of alignment with the axial passage provided by the part (1*a*) formed by adjacent turns (practically without separation between two successive turns) and of an approximately equivalent diameter. The riveting operation permits the formation of a strong interlocking union between both the spiral (1) and the bearing (2), the rivet (3) being extended between the upper external part of the bearing (2) and the lower end of the mentioned part (1*a*). As will be understood, the relative rotational movement of the spiral body (1)** is now facilitated, as no friction exists with any of the corkscrew parts in which it is fitted.

It is not considered necessary to extend the contents of this description any further for an expert in the matter to be able to understand its scope and advantages.

Nevertheless, and given that the execution described only corresponds to an example of use, it is clear that variations may be introduced, without changing the scope of the invention. Such modifications include shape, size and/or the materials used to manufacture the assembly or its parts.

What is claimed is:

1. A spiral for a corkscrew, comprising a spiral member having a pointed end for introduction into a cork of a bottle, said spiral member having a part which is located opposite to said pointed introduction end and has an opposite end; a ball bearing connected with said opposite end of said part of said spiral member, so that during introduction of said spiral member into a cork and removal of said spiral member from the cork said spiral member is rotated relative to a rest of the corkscrew; and means for connecting said ball bearing with said opposite end of said part of said spiral member.

2. A spiral for a corkscrew as defined in claim 1, wherein said part of said spiral member is formed by several turns arranged one on the other without separation and having a diameter equivalent to a diameter of remaining turn of said spiral member.

3. A spiral for a corkscrew as defined in claim 1, wherein said part of said spiral member has an axial passage, said ball bearing having an axial hole, said connecting means having a connecting member which extends through said axial hole of said ball bearing and said axial passage of said part of said screw member.

4. A spiral for a corkscrew as defined in claim 3, wherein said connecting member is formed as a rivet.

* * * * *